United States Patent [19]

Araki et al.

[11] Patent Number: 4,656,387

[45] Date of Patent: Apr. 7, 1987

[54] CATHODE RAY TUBE HAVING A ZIG-ZAG SHAPED DEFLECTION ELECTRODE

[75] Inventors: Shoji Araki; Shinichi Numata, both of Kanagawa, Japan

[73] Assignee: Sony Corporation, Tokyo, Japan

[21] Appl. No.: 643,399

[22] Filed: Aug. 23, 1984

[30] Foreign Application Priority Data

Aug. 29, 1983 [JP] Japan ..... 58-157646

[51] Int. Cl.[4] ..... H01J 29/62; H01J 29/74; H01J 31/38

[52] U.S. Cl. ..... 313/389; 313/340; 313/432; 313/434; 313/458; 313/450

[58] Field of Search ..... 313/384, 389, 390, 432, 313/434, 421, 449, 458, 460, 479, 450

[56] References Cited

U.S. PATENT DOCUMENTS 2,681,426 6/1954 Schlesinger ..... 313/432 X 3,731,136 5/1973 Roussin ..... 313/434 X

FOREIGN PATENT DOCUMENTS 121662 9/1979 Japan ..... 313/479

*Primary Examiner*—David K. Moore
*Assistant Examiner*—K. Wieder

[57] ABSTRACT

A cathode ray tube comprises an envelope, an electron gun having a beam limiting aperture, a first electrode, a second electrode, a third electrode and a mesh electrode, the first, second and third electrodes constituting electrostatic lens system to focus the electron beam, the second electrode being a deflection electrode of arrow or zig-zag patterns to deflect the electron beam, wherein if distance between the beam limiting aperture and the mesh electrode is l, length of the second electrode is made ($\frac{1}{3}$ l−1/10 l) and ($\frac{1}{3}$ l+1/10 l), and distance between the beam limiting aperture and the center of the second electrode is made ($\frac{1}{2}$ l−$\frac{1}{3}$ l) to ($\frac{1}{2}$ l).

1 Claim, 13 Drawing Figures

CATHODE RAY TUBE HAVING A ZIG-ZAG SHAPED DEFLECTION ELECTRODE

BACKGROUND OF THE INVENTION

1 Field of the Invention:

The present invention relates to a cathode ray tube which is suitably applied to an image pick-up tube of electrostatic focus/electrostatic deflection type for example.

2 Description of the Prior Art:

Image pick-up tubes of magnetic focus/magnetic deflection type or electrostatic focus/magnetic deflection type are known in the prior art. In these image pick-up tubes in usual, good characteristics can be obtained when the tube length is long. However, if the image pick-up tube is used in a video camera of small size for example, the tube length is preferably short, because the video camera as a whole may be made compact.

When the image pick-up tube is used in the video camera of small size, the power consumption is preferably little.

SUMMARY OF THE INVENTION

In view of above-mentioned circumstances, an object of the present invention is to provide a cathode ray tube which is compact and light-weight and has little power consumption and good characteristics.

In order to attain the object, a cathode ray tube of the invention comprises an envelope, an electron gun having a beam limiting aperture, a first electrode, a second electrode, a third electrode, a mesh electrode and a target, the first, second and third electrodes constituting electrostatic lens system to focus the electron beam, the $G_4$ electrode being a deflection electrode of arrow or zig-zag patterns to deflect the electron beam, wherein if distance between said beam limiting aperture and the mesh electrode is represented by l, length of the second electrode is made ($\frac{1}{3}$l−1/10l) to ($\frac{1}{3}$l+1/10 l), and distance between the beam limiting aperture and the center of the second electrode is made ($\frac{1}{2}$l−$\frac{1}{3}$l) to $\frac{1}{2}$l.

DESCRIPTION OF THE PREFERRED EMBODIMENTS

Figure 1:
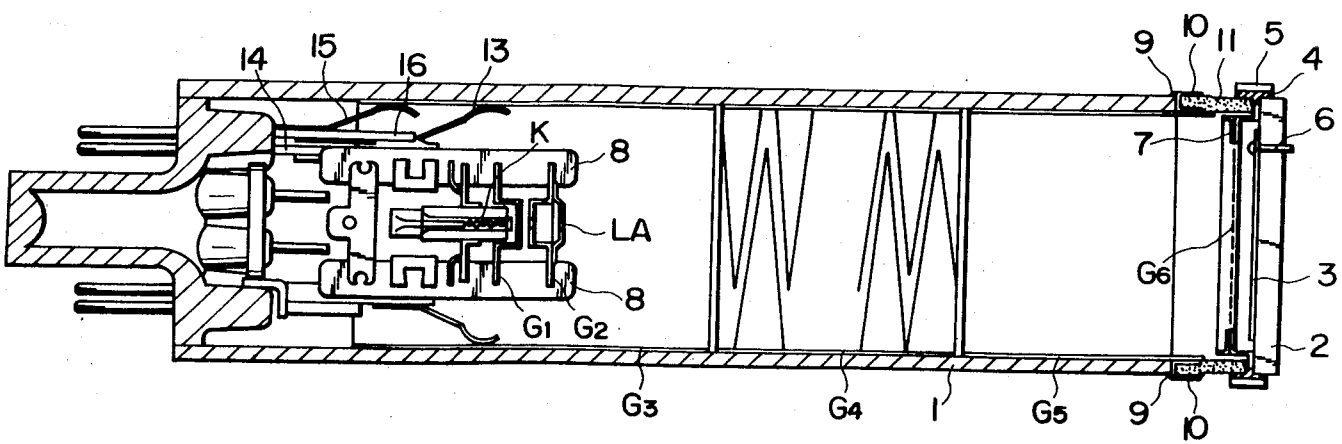
FIG. 1 is a sectional view of a cathode ray tube as an embodiment of the invention.

An embodiment of the present invention will now be described referring to FIG. 1. The embodiment is an example of application of the invention to an image pick-up tube of electrostatic focus/electrostatic deflection type (S.S type).

In the figure, reference numeral 1 designates a glass bulb, numeral 2 a face plate, numeral 3 a target screen (photoconductor screen), numeral 4 indium for cold sealing, and numeral 5 a metal ring. Numeral 6 designates a pin electrode for signal taking, which penetrates the face plate 2 and contacts with the target screen 3. $G_6$ designates a mesh electrode mounted on a mesh holder 7. The mesh electrode $G_6$ is connected through the mesh holder 7 and the indium 4 to the metal ring 5. Prescribed voltage $E_{G6}$ is impressed to mesh electrode $G_6$ through the metal ring 5.

In FIG. 1, K, $G_1$ and $G_2$ designate respectively a cathode, a first grid electrode and a second grid electrode, all constituting an electron gun. Numeral 8 designates a bead glass to fix these electrodes. LA designates a beam limiting aperture.

In FIG. 1, $G_3$, $G_4$ and $G_5$ designate respectively a third grid electrode, a fourth grid electrode and a fifth grid electrode, corresponding to the first, second and third electrodes in the invention. These electrodes are made in a process that metal such as chromium or aluminum is evaporated or plated on inner surface of the glass bulb 1 and then prescribed patterns are formed by laser cutting or photo etching. In the invention, focusing electrodes system is constituted by the electrodes $G_3$, $G_4$ and $G_5$, and the electrode $G_4$ serves also as deflection electrode.

The electrode $G_5$ is connected to a conductive layer 10 formed on a surface of a ceramic ring 11 which is frit-sealed 9 to an end of the glass bulb 1. The conducting layer 10 is formed by sintering Ag paste, for example. Prescribed voltage $E_{G5}$ is impressed to the electrode $G_5$ through the ceramic ring 11.

Figure 2:
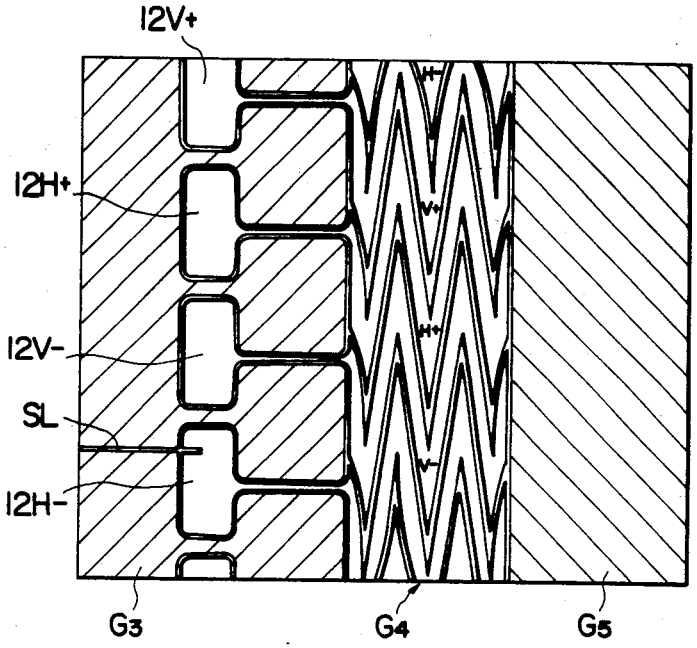
FIG. 2 is a development of the electrodes $G_3$, $G_4$, $G_5$ in FIG. 1.

In FIG. 1, the electrodes $G_3$, $G_4$ and $G_5$ are formed as shown in a development of FIG. 2. That is, the electrode $G_4$ is made patterns where four electrodes $H_+$, $H_-$, $V_+$, $V_-$ are insulated and interleaved and alternately arranged (arrow or zig-zag patterns). Leads (12$H_+$), (12$H_-$), (12$V_+$) and (12$V_-$) from these electrodes $H_+$, $H_-$, $V_+$, $V_-$ are also formed on inner surface of the glass bulb 1 simultaneously to the formation of the electrodes. The leads (12$H_+$), (12$H_-$), (12$V_+$) and (12$V_-$) are insulated from the electrode $G_3$ and cross it. In FIG. 2, SL designates a slit to prevent the $G_3$ electrode from being heated when the electrodes $G_1$ and $G_2$ are heated from outside of the tube for evacuation.

In FIG. 1, numeral 13 designates a contactor spring with one end connected to a stem pin 14, and other end of the spring 13 is contacted with the leads (12$H_+$), (12$H_{31}$), (12$V_+$) and (12$V_-$). The spring and the stem pin are provided to each of the leads (12$H_+$), (12$H_{31}$), (12$V_+$) and (12$V_-$). The electrodes $H_+$ and $H_-$ to constitute the electrode $G_4$ are supplied with horizontal deflection voltage which varies symmetrically from prescribed voltage $E_{G4}$ as center. The electrodes $V_+$ and $V_-$ are also supplied with vertical deflection voltage which varies symmetrically from prescribed voltage $E_{G4}$ as center.

Further in FIG. 1, numeral 15 designates a contactor spring with one end connected to a stem pin 16, and other end of the spring 15 is connected to the electrode $G_3$. Prescribed voltage $E_{G3}$ is impressed to the electrode $G_3$ through the stem pin 16 and the spring 15.

Voltage $R_{G3}$ of the $G_3$ electrode is made, for example, 0.6 $E_{G5}$ to 1.5 $E_{G5}$ with respect to voltage $E_{G5}$ of the $G_5$ electrode. Voltage $E_{G6}$ of the $G_6$ electrode is made voltage enough to eliminate the landing error, and voltage $E_{G4}$ of the $G_4$ electrode is made voltage to optimize the focusing. In this case, characteristics do not appreciably vary depending on voltage difference.

Figure 3:
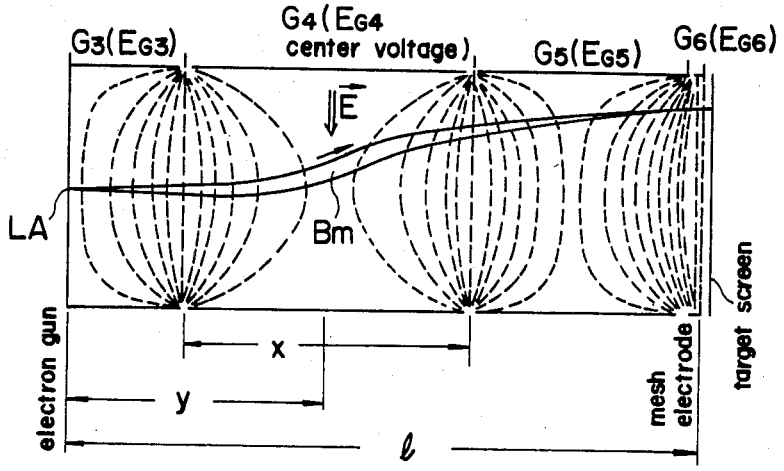
FIG. 3 is a diagram illustrating equipotential surface of electrostatic lenses formed by the cathode ray tube in the embodiment.

In FIG. 3, broken line shows equipotential surface of electrostatic lenses formed by the electrodes $G_3-G_6$, and focusing of electron beam $B_m$ is performed by the electrostatic lenses. The electrostatic lens formed between the electrodes $G_5$ and $G_6$ corrects the landing error. Deflection of the electron beam $B_m$ is performed by the deflection electrode field E of the electrode $G_4$.

Parameters to determine characteristics of the S.S type are length x of the $G_4$ electrode (length of deflection electrode), distance y between the beam limiting aperture LA and the center of the $G_4$ electrode (position of deflection electrode), and distance between the beam limiting aperture LA and the mesh electrode $G_6$ (tube length).

Figure 4:
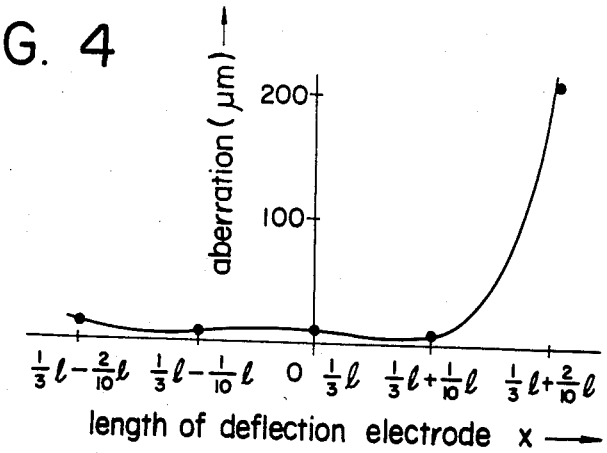
FIG. 4 is a graph illustrating relation between aberration and length of the deflection electrode.
Figure 5:
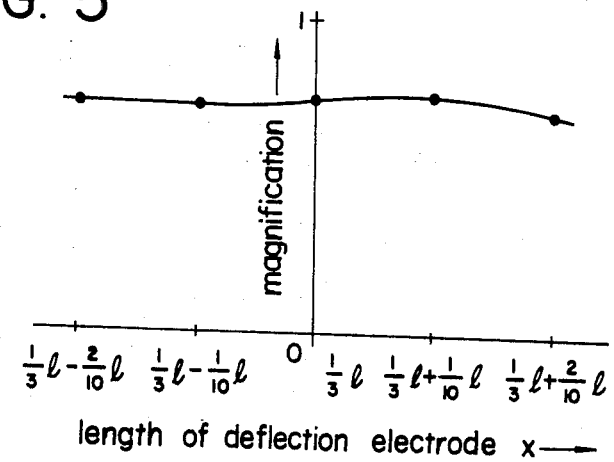
FIG. 5 is a graph illustrating relation between magnification and length of the deflection electrode.
Figure 6:
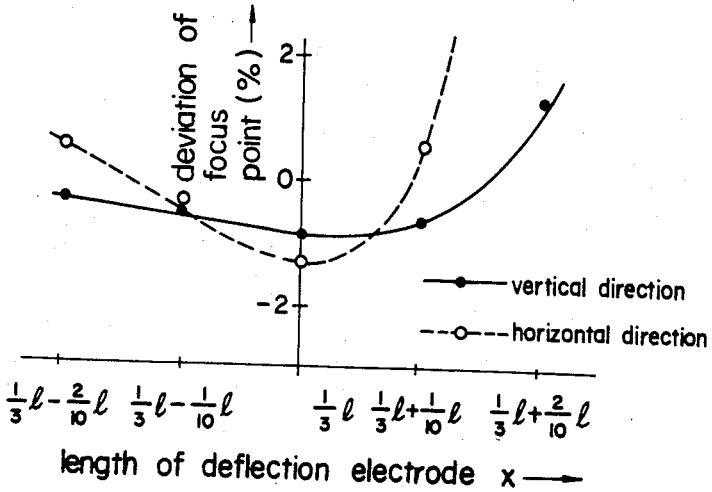
FIG. 6 is a graph illustrating relation between deviation of focus point and length of the deflection electrode.

FIG. 4, FIG. 5 and FIG. 6 show relation between aberration and length x of the deflection electrode, between magnification and length x and between deviation of focus point and length x, respectively in the image pick-up tube of $\frac{2}{3}$ inches (tube diameter $\phi=16$ mm), where $l=3.5\ \phi$, $y=\frac{1}{2}$, angle of divergence $=\tan^{-1} 1/50$, $El_{G3}=E_{G5}=500$ V, $E_{G4}$ is determined to optimize the focusing, and $E_{G6}$ is so determined that the landing error is within $\pm 0.2/100$ radian during the deflection at 4.4 mm.

FIG. 4 shows aberration when the deflection distance is 4.4 mm. FIG. 6 shows deviation of focus point when the deflection distance is 4.4 mm in horizontal direction, and solid line shows deviation in the vertical direction and broken line shows that in the horizontal direction. In this case, deviation from the target screen is shown in % with respect to the tube length l (positive value at front side of the target screen, and negative value at rear side thereof).

It is seen from FIG. 4 that the aberration rapidly increases if length x of the deflection electrode becomes $(\frac{1}{3}l+1/10l)$ or more. If length x of the deflection electrode becomes too short, the deflection voltage must be high so as to increase the power. Therefore length x is preferably longer than $(\frac{1}{3}l-1/10\ l)$. It is seen from FIG. 5 that magnification scarcely varies depending on length x of the deflection electrode. It is seen further from FIG. 6 that deviation of focus point is little if length x of the deflection electrode ranges $(\frac{1}{3}l-1/10\ l)$ to $(\frac{1}{3}l+1/10\ l)$.

From above description, length x of the deflection electrode preferably ranges $(\frac{1}{3}l-1/10\ l)$ to $(\frac{1}{3}l+1/10\ l)$. Consequently, in FIG. 1, length x of the $G_4$ electrode is made $(\frac{1}{3}l-1/10\ l)$ to $(\frac{1}{3}l+1/10\ l)$.

Figure 7:
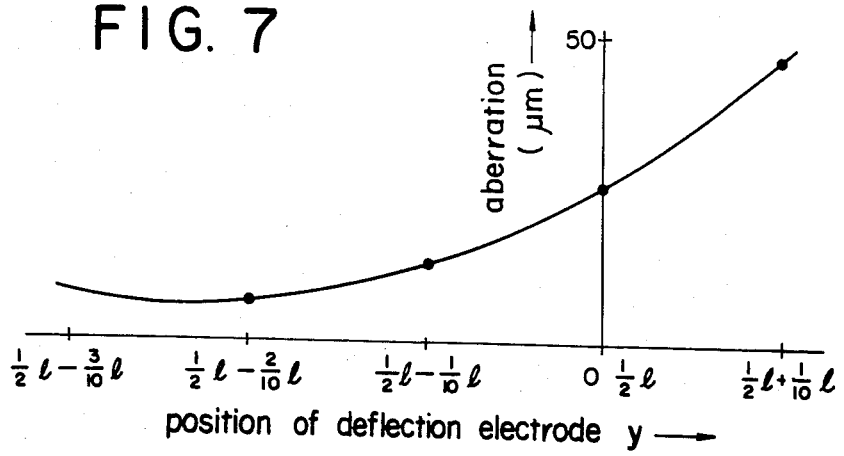
FIG. 7 is a graph illustrating relation between aberration and position of the deflection electrode.
Figure 8:
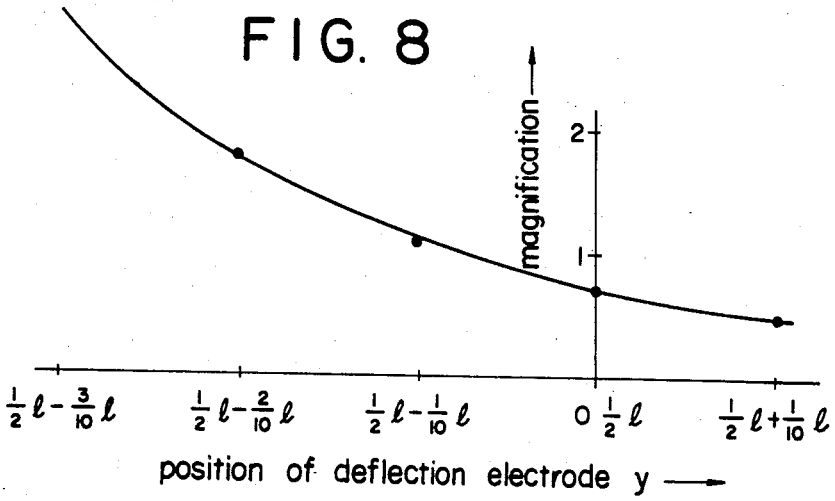
FIG. 8 is a graph illustrating relation between magnification and position of the deflection electrode.
Figure 9:
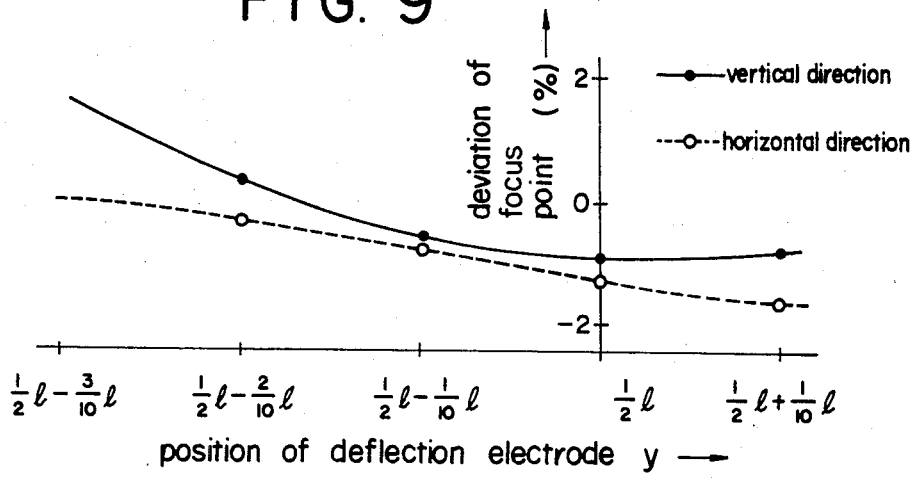
FIG. 9 is a graph illustrating relation between deviation of focus point and position of the deflection electrode.

FIG. 7, FIG. 8 and FIG. 9 show relation between aberration and position y of the deflection electrode, between magnification and position y and between deviation of focus point and position y, respectively where $x=\frac{1}{3}l$ and other conditions are specified as above.

FIG. 7 shows aberration when the deflection distance is 4.4 mm. FIG. 9 shows deviation of convergence point when the deflection distance is 4.4 mm in horizontal direction.

It is seen from FIG. 7 that the more the position y of the deflection electrode, the more the aberration. On the other hand, it is seen from FIG. 8 that the smaller the position y, the more the magnification. Summarizing this, it is seen from FIG. 7 and FIG. 8 that if position y of the deflection electrode ranges $(\frac{1}{2}l-\frac{1}{3}l)$ to $\frac{1}{2}l$, the aberration and the magnification do not become appreciably large but are satisfactory for the practicable use. In this case, if the magnification is high, the beam limiting aperture LA may be decreased for the compensation. It is seen further from FIG. 9 that deviation of focus point is little if position y of the deflection electrode ranges $(\frac{1}{2}l-\frac{1}{3}l)$ to $\frac{1}{2}l$.

From above description, position y of the deflection electrode preferably ranges $(\frac{1}{2}l-\frac{1}{3}l)$ to $\frac{1}{2}l$. Consequently, in FIG. 1, position y of the $G_4$ electrode is made $(\frac{1}{2}l-\frac{1}{3}l)$ to $\frac{1}{2}l$.

In S.S type as shown in FIG. 1, the tube length may be shortened without producing any trouble in comparison to others.

In electrostatic focus/magnetic deflection type (S.M type) and magnetic focus/magnetic deflection type (M.M type), for example, deflection is performed by magnetic field. If electron is deflected by magnetic field, kinetic energy of the electron does not vary but velocity component in the axial direction decreases during the deflection, resulting in a curvature of the image field, thereby defocus occurs at peripheral portion of the target screen. The defocus is corrected usually by dynamic focus, but if the tube length is shortened the deflection angle increases and the curvature of the image field also increases thereby the correction is more required. In magnetic deflection, the deflection center varies depending on the deflection amount, and if the tube length is shortened the deflection angle increases and variation of the deflection center also increases. If the landing error is corrected by the collimation lens in this state, the landing angle characteristics will be deteriorated.

Further in the S.M type and M.M type, the deflection power is approximately proportional to 1/(tube length)$^2$ and therefore if the tube length is shortened the power consumption required for the deflection will increase drastically.

On the contrary, in the magnetic focus/electrostatic deflection type (M.S type) and the electrostatic focus/electrostatic deflection type (S.S type), deflection is performed by electric field and therefore if the tube length is shortened above-mentioned trouble will not be produced as done in the magnetic deflection.

Further in the M.M type and M.S type, the focusing power is proportional to 1/(tube length)$_2$ and therefore if the tube length is shortened the power consumption required for the focusing will increase drastically.

Consequently, only in S.S type, the tube length may be shortened without producing any trouble in principle.

The inventors in the present patent application further studied the S.S type, and as a result obtained the conclusion that unless the tube length is shortened to some extent the characteristics will be deteriorated.

This will be explained referring to FIG. 10.

Figure 10A:
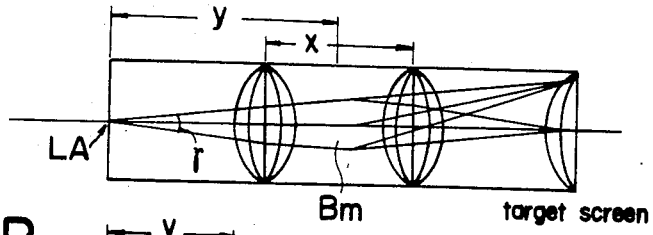
FIGS. 10A and 10B are diagrams illustrating lens action of the invention.
Figure 10B:
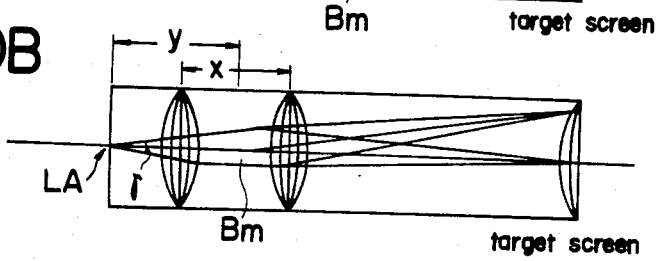

If the tube length l is long, when the electron beam $B_m$ is entered into the electrostatic lens as shown in FIG. 10A, the diameter of the beam is enlarged by the divergence angle, $\gamma$, and therefore the electron beam aberration at focusing onto the target screen increases on account of the lens aberration. In order to improve this, the electron beam $B_m$ must be entered into the electrostatic lens before diverged much. For example, the distance y is decreased as shown in FIG. 10B. In this case, however, the center of the electrostatic lens is shifted to side of the beam limiting aperture LA and the magnification becomes large (e.g. 2.0 or more), and therefore diameter of the beam limiting aperture LA must be decreased and this is not preferable from the viewpoint of manufacturing.

On the contrary, if the tube length l is short, the electron beam $B_m$ is entered into the electrostatic lens before diverged much thereby the aberration is suppressed.

However, if the tube length l is made too short, since the deflection angle becomes large the landing error must be corrected by increasing the magnitude of collimation thereby aberration based on distortion of the collimation lens increases.

Consequently, in the S.S type, unless the tube length is shortened to some extent the characteristics will be deteriorated.

Figure 11:
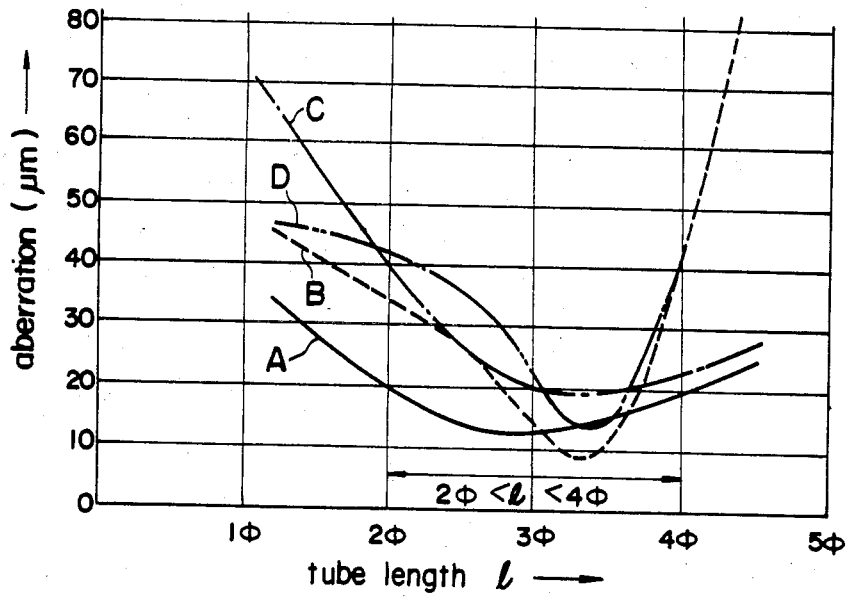
FIG. 11 is a graph illustrating relation between aberration and the tube length.

FIG. 11 shows aberration characteristics when the tube length l is varied at prescribed values of x, y in the image pick-up tube of $\frac{2}{3}$ inches (tube diameter $\phi=16$ mm) where angle of divergence $=\tan^{-1} 1/50$, $E_{G3}=E_{G5}=500$ V, $E_{G4}$ is determined to optimize the focusing and $E_{G6}$ are so determined that the landing error is within $\pm 0.2/100$ radian during the deflection at 4.4 mm.

In FIG. 11, solid line A, broken line B, dash-and-dot line C and dash-and-two dots line D show aberration characteristics in ($x=\frac{1}{3}l-1/10\ l$, $y=\frac{1}{2}l-1/10\ l$), ($x=\frac{1}{3}l+1/10\ l$, $y=\frac{1}{2}l-1/10\ l$), ($x=\frac{1}{3}l-1/10\ l$, $y=\frac{1}{2}l$) and ($x=\frac{1}{3}l+1/10\ l$, $y=\frac{1}{2}l$), respectively.

It is seen from FIG. 11 that the tube length l is preferably $2\phi$ to $4\phi$ in the S.S type.

On the contrary to the S.S type as above described, the practicable and existing M.M type has $l=4\phi$ or more, and S.M. type has $l=4\phi$ to $5\phi$. The M.S type may have $l=3\phi$ but the power for the focusing cannot be ignored then. Consequently, in order to minimize the power consumption without deteriorating the characteristics, the tube length can be most shortened by adopting the S.S type.

The image pick-up tube of $\frac{2}{3}$ inches (tube diameter $\phi=16$ mm) was manufactured by trial in $l=2.8\phi$, $x=\frac{1}{2}l$, $y=\frac{1}{2}l-1/10l$, voltages impressed to the $G_1$ and $G_2$ electrodes being 6 V and 320 V respectively, voltage of the target screen 3 being 50 V, $E_{G3}=E_{G5}=400$ V, $E_{G4}=-20$ V $\pm 65$ V, $E_{G6}=960$ V. According to this tube, amplitude response at the center (at 400 TV lines) becomes 50%, amplitude response at peripheral portion (at 400 TV lines) becomes 30%, landing angle (at whole surface) becomes 0.5/100 radian or less, and the deflection linearity(during deflection at 4.4 mm) becomes 0.3%. Consequently, this tube has characteristics equivalent to that of the existing mix field type (M.F type).

Accordingly, in the constitution of S.S type as shown in FIG. 1, the tube length l may be shortened and the deflection coil and the focusing coil are unnecessary and the cathode ray tube being compact and light-weight is obtained. Moreover, since deflection and focusing are performed electrostatically, little power consumption is required. Since length x and position y of the $G_4$ electrode are set to optimum values, good characteristics can be obtained.

In the embodiment of FIG. 1, metal is adhered in patterns onto inner surface of the glass bulb thereby the electrodes are formed. Consequently, diameter of the collimation lens may be made approximately as large as the inner diameter of the glass bulb. If the tube length is shortened, the deflection angle increases thereby the collimation lens must be strengthened. However, since the diameter of the collimation lens may be made large as above described, even if the collimation lens is strengthened, the aberration will not increase and the landing angle characteristics not be deteriorated.

Figure 12:
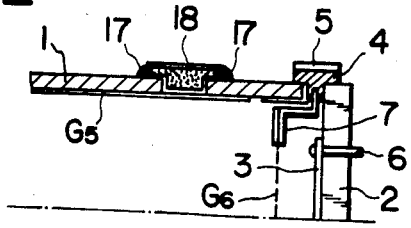
FIG. 12 is a sectional view of main part of another embodiment of the invention.

In order to impress voltage to the electrode $G_5$, as shown in another embodiment of FIG. 12, a ceramic ring 18 with surface coated by a conductive layer such as Ag paste or the like may be frit-sealed 17 at midway of the glass bulb 1 opposite to the $G_5$ electrode and voltage be impressed through the ceramic ring 18. Although not shown in the figure, a hole may be bored through the glass bulb 1 opposite to the $G_5$ electrode and a metal pin may be soldered or a conductive frit be installed so as to impress voltage through the metal pin or the conductive frit to the electrode $G_5$.

Although the electrodes $G_3-G_5$ are adhered to inner surface of the glass bulb 1 in the embodiment, the invention can be applied also to electrodes made of metal plate for example.

Although the embodiments concern the cathode ray tube of $\frac{2}{3}$ inches, the invention can be also applied to any size.

Although the above embodiments disclose application of the invention to the image pick-up tube of S.S type, the invention is not restricted to this but can be applied also to the cathode ray tube such as storage tube, scan converter tube, or the like.

According to the invention as above described, since the cathode ray tube is constituted in S.S type, the tube length l may be shortened and the deflection coil and the focusing coil are unnecessary thereby the cathode ray tube being compact and light-weight can be obtained. Moreover, since deflection and focusing are performed electrostatically, little power consumption is required. Since length and position of the $G_4$ electrode are set to optimum values, good characteristics can be obtained.

What is claimed is:

1. A cathode ray tube comprising an envelope, an electron gun having a beam limiting aperture, a first electrode, a second electrode, a third electrode, a mesh electrode, and a target, said first, second and third electrodes constituting electrostatic lens system to perform focusing of electron beam, said second electrode being a deflection electrode of arrow or zig-zag patterns to perform deflection of the electron beam, wherein if distance between said beam limiting aperture and said mesh electrode is l, length of said second electrode is made ($\frac{1}{3}l-1/10\ l$) to ($\frac{1}{3}l+1/10\ l$), and distance between said beam limiting aperture and the center of said second electrode is made ($\frac{1}{2}l-\frac{1}{3}l$) to $\frac{1}{2}l$, and wherein the length l is in the range of $2\phi$ to $4\phi$ where $\phi$ is the inner diameter of said first, second and third electrodes and for $\phi$ equal two third inches, l being not greater than two and two-thirds inches.

* * * * *